US007421240B2

(12) United States Patent
Moser

(10) Patent No.: US 7,421,240 B2
(45) Date of Patent: Sep. 2, 2008

(54) ASYMMETRIC AC CLEANER FOR IMPROVED TONER CHARGE DISTRIBUTION IN SCAVENGING DEVELOPMENT SYSTEMS

(75) Inventor: Rasin Moser, East Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 148 days.

(21) Appl. No.: 11/594,471

(22) Filed: Nov. 8, 2006

(65) Prior Publication Data

US 2008/0107439 A1 May 8, 2008

(51) Int. Cl.
*G03G 21/00* (2006.01)

(52) U.S. Cl. ..... 399/354; 399/44; 399/71; 399/349

(58) Field of Classification Search ..... 399/354, 399/353, 349, 71, 343, 44
See application file for complete search history.

(56) References Cited

U.S. PATENT DOCUMENTS

| | | | | |
|---|---|---|---|---|
| 5,655,204 | A * | 8/1997 | Siegel | 399/349 |
| 5,937,228 | A * | 8/1999 | Shoji et al. | 399/44 X |
| 6,269,236 | B1 * | 7/2001 | Mori et al. | 399/354 |
| 7,257,362 | B2 * | 8/2007 | Facci et al. | 399/349 X |
| 2005/0111893 | A1 * | 5/2005 | McStravick et al. | 399/354 |
| 2006/0291885 | A1 * | 12/2006 | Radulski et al. | 399/71 |
| 2007/0172274 | A1 * | 7/2007 | Lundy et al. | 399/349 |

FOREIGN PATENT DOCUMENTS

JP 57-060363 A * 4/1982

* cited by examiner

*Primary Examiner*—Sophia S Chen
(74) *Attorney, Agent, or Firm*—James J. Ralabate

(57) ABSTRACT

This is a cleaning system useful in an electrophotographic marking system which takes up a small space in space important marking apparatus. It involves applying an asymmetric AC wave-form to a cleaning brush. Wrong sign or unwanted toner will be attracted to this cleaner brush and removed from the system.

17 Claims, 2 Drawing Sheets

ASYMMETRIC AC CLEANER FOR IMPROVED TONER CHARGE DISTRIBUTION IN SCAVENGING DEVELOPMENT SYSTEMS

This invention relates to cleaning a photoconductive surface in an electrophotographic system and, more specifically, to a system of removing, both right and wrong sign toner from said surface.

BACKGROUND

Xerography is one type of an electrostatographic marking process. In this process, a uniform electrostatic charge is placed upon a photoreceptor surface. The charged surface is then exposed to a light image of an original to selectively dissipate the charge to form a latent electrostatic image of the original. The latent image in a Xerographic system is generally developed by depositing finely divided and charged particles of toner upon the photoreceptor surface. The charged toner being electrostatically attracted to the latent electrostatic image areas to create a visible replica of the original. The developed image is then usually transferred from the photoreceptor surface to a final support material such as paper and the toner image is fixed thereto to form a permanent record corresponding to the original.

In a typical Xerographic monochrome copier or printer, a photoconductor surface is generally arranged to move in an endless path through the various processing stations of the Xerographic process. When the photoreceptor surface is reusable, the toner image is then transferred to a final support material, such as paper, and the surface of the photoreceptor is prepared to be used once again for the reproduction of a copy of an original. Although a preponderance of the toner image is transferred to the paper during the transfer operation, some of the toner and toner agents forming the image are unavoidably left behind on the photoconductor surface including residual wrong sign toner and toner additives. These remaining wrong sign toner and toner agents on the photoreceptor surface after the image transfer are referred to as residual toner and residual additives or agents. Residual toner also includes any patches or bands of right sign toner not transferred to the final support material. Many typical copiers or printers use particularly placed and developed patches or bands of toner for process control, and these patches or bands of toner must also be removed by the toner removal apparatus. Thus, substantially all residual toner and agents must be removed from the photoreceptor to prevent degrading or ghosting on subsequent copies reproduced by the copier or printer. Optimally, the residual toner and agents are removed without re-depositing the toner into the developer sump or onto the photoreceptor or smearing the toner on the photoreceptor surface as an unacceptable film.

One widely accepted method of cleaning residual toner from the surface of a photoreceptor of a typical copier or printer is by means of a cylindrical brush or brushes rotated in contact with the photoreceptor surface at a relatively high rate of speed. Generally, rotatable brushes are mounted in interference contact to the photoreceptor surface to be cleaned, and the brushes are rotated so that the brush fibers continually wipe across the photoreceptor. Electrical bias applied to conductive brush fibers aids in removing and transporting cleaned material away from the photoreceptor surface. In order to reduce the dirt level within the brush, a flicker bar and vacuum system may be provided which removes some residual toner and toner agents from the brush fibers and exhausts some of the residual toner and toner agents from the cleaner. Unfortunately, the brush could become contaminated with toner and toner agents and, after extended usage, needs to be replaced. Brush life is ultimately compromised by toner and additive impaction on fiber ends affects conductivity and physical changes to brush through mechanical or electrical breakdown that affect the mechanical integrity and/or electrical conductivity. With increased processing speeds of copiers and printers and the expanded use of toner agents, the foregoing brush cleaning techniques are not practical without substantial improvements.

Toner charge tends to drop in moist environments. Wrong sign toners can be created which contribute to broad charge distributions and resultant background on prints or image graininess. DualElectroStatic Brush cleaners have managed this issue in the past but have fallen from favor due to cost and process waterfront impacts. Charge distribution can be driven towards correct sign and pushed to higher Q/m, Q/d through changes in base resin, additives or carrier selection. However, these high-charging materials packages typically constrain development latitude in dry environments, eventually causing light prints or process controls faults or excessive toner concentrations or breakdown, etc. Also, in today's marking systems, toners are customized to contain certain toner agents to improve charge control toner transfer, flow and other desirable variations in the toner. Some agents include $TiO_2$, $SiO_2$, Zinc stearates and other known toner agents. There have been substantial ghosting and filming problems in these systems due to accumulation of wrong sign toners and these toner additives on the photoreceptor. While most prior art cleaning stations and electrostatic brush cleaners have been concerned with only right sign toner removal, it has become apparent that new and improved cleaning systems are needed for one brush to remove both wrong sign toner and toner agents or additives from the photoreceptor. Many difficulties were encountered to accomplish this primarily because of the very small size and relatively high amount of wrong charge of the toner and additives or agents. This has been further complicated because, for a functional solution, the wrong sign toner and additive cleaning latitude must sufficiently overlap the toner particle cleaning latitude. In addition, the removal of these wrong sign toner and toner agents becomes further complicated since the agents can be about 100 times smaller than the toner particle. While these agents are a dust size, they are highly charged and easily cling to the surface of the photoreceptor. Efficient removal of right sign toners and of these wrong sign toner agents and wrong sign toner is necessary to prevent or minimize ghosting and background on the final copy paper surface produced by the marking system or apparatus. It is recognized that while wrong sign toners may pass by a toner cleaning station, they have a propensity to be re-ingested by contact method development stations which are oppositely charged. This scavenging of wrong sign toner contributes, over time, to lowering the developer sump charge distribution.

Since most toners used today are negatively charged, the embodiments throughout this disclosure and claims will be described relating to the use of a negative toner. However, when a positive toner is used, the proper opposite adjustments can easily be made. Thus, when "wrong sign" toner or toner additives are referred to in this disclosure, the indication is that "wrong sign" designates a positively charged toner or additive. Therefore, "wrong sign toner" as used herein will include both wrong sign toner and wrong sign toner additives.

SUMMARY

To avoid substantially all of the problems noted above, the present embodiments involve applying an asymmetric AC wave-form to the cleaner brush. Wrong sign toner or toner additives will be attracted to the cleaner brush and removed from the Xerographic system by means including those above noted. This removal from the system will tend to deplete the developer sump of wrong sign particles including toner and additives. The duty cycle of the AC wave-form could be optimized for a developer according to the material-charging behavior at variable humidities. The function of a cleaning brush in an electrophotographic system is to clean residual toner and toner additives off the photoconductor after the image has been transferred to a receiving member such as paper. Both the residual toner and toner additives include both right sign (usually negative charged) and wrong sign (usually positive charged). To ensure that both right and wrong sign particles are removed from the photoconductor, some systems use two cleaning brushes, one biased negatively and one biased positively. Since space is a very important consideration in today's compact marking apparatus, elimination of one brush to accomplish the same result is very desirable.

The present embodiments involve using only one cleaning brush and applying an asymmetric AC wave form to the brush. This will allow the brush to clean not only right sign particles from the photoconductor's surface, but will permit it to also remove wrong sign particles.

Wrong sign toners are created and tend to accumulate in the developer sump because they are typically attracted to the development bias. Humid conditions exacerbate this accumulation by increasing carrier and toner conductivities which in turn decrease charge polarization and increase charge exchange. Any wrong sign toner that manages to cross to the photoconductor is usually not transferred and therefore does not contribute significantly to background on prints. DESB (DualElectroStaticBrush) cleaners manage to remove any remaining wrong sign toners. Reduced cost Single ESB cleaners can only reduce residual wrong sign toners (both original wrong sign as well as wrong sign created by transfer event) by PreClean treatment which, while effective, is limited in range. In interactive, scavenging brush development systems (i.e., SCMB), wrong sign toners will be reingested into the housing and, over time, will tend to broaden the charge distribution with low sign and wrong sign tails, thereby contributing to background on prints and other development dysfunction. It is important that the AC power source in the present embodiments be adjustable depending upon the humidity and other conditions existing at the cleaning time.

It is proposed, as above noted, that an asymmetric AC wave-form be applied to the cleaner brush where the ESB (Electrostatic Brush) is usually held at the normal cleaning (positive) potential but swings negative for a short time during each cycle. The AC frequency is tuned such that each toner expects to experience a few (2-10) cycles as it passes through the cleaning nip (100-500 Hz for 600 mm/sec with 12 mm nip). The duty cycle of the AC wave-form could be optimized for a developer package according to the material charging behavior at variable humidities, i.e. higher humidities would call for longer negative swings of wave-form. It is important that asymmetrical AC bias be used since a symmetrical AC bias would interfere with the cleaning process and would not be sufficient to clean right sign toner. Thus, symmetrical AC bias would deter overall cleaning efficiency of the system.

An advantage of this cleaning approach is that it may provide a "charge selective sump cleansing" function increasing development latitude by enabling developer packages that charge lower, therefore develop better (especially in dry conditions), without the cumulative wrong sign buildup that can contribute to unacceptable background on prints. Further, this approach can be modified to be used as part of a "rest recovery" routine, assisting wrong sign purge through specified cleaning routines (high Vmc and more negative ESB bias) during IQ setup routines invoked during "cold-start" conditions or other times when the charge distribution should be pushed higher.

Therefore, this invention provides a toner-cleaning system using an asymmetric AC cleaner bias in a single electrostatic brush (SESB) cleaner to help clean wrong sign toner in addition to cleaning right sign toner. In a scavenging or interactive development system, wrong sign toner left on the photoconductive PR surface would be scavenged by the developer thus shifting the charge distribution of the developer in the sump toward low sign or wrong sign toner. It is provided herein that an asymmetric AC bias be applied at a frequency sufficiently low so that wrong sign (positive) toner will experience a few negative cycles as it passes through the nip and thereby be picked up by the brush. The duty cycle would be adjusted so as to pick up the negative toner without adversely affecting right sign toner cleaning.

When the term "cleaning nip" is used throughout this disclosure, it signifies the portion of the brush that contacts the photoreceptor surface.

In some electrophotographic systems, two cleaning brushes are used which takes up space (for extra brush) and adds costs to the system. The expedient of using asymmetric AC bias avoids the necessity of a second biased cleaning brush. The charge potential applied to the cleaning brush is from about 250-350 volts. However, any suitable voltage can be used. The wrong sign toner can be removed from the system by any convenient means such as shown in FIG. 1 below. The AC power supply and charge means of the embodiments and the brush are located after the transfer station but before the charging station of the electrophotographic system.

By removing this wrong sign toner and preventing it from re-entering the toner developer sump, the integrity of the right sign toner in the sump is maintained. The AC power supply is in continuous electrical contact with the cleaning brush so that the removal of wrong sign toner continues throughout the process. A conductive arbor or spindle is one suitable means of connecting the brush to the AC charger.

DETAILED DISCUSSION OF DRAWINGS AND PREFERRED EMBODIMENTS

Figure 1:
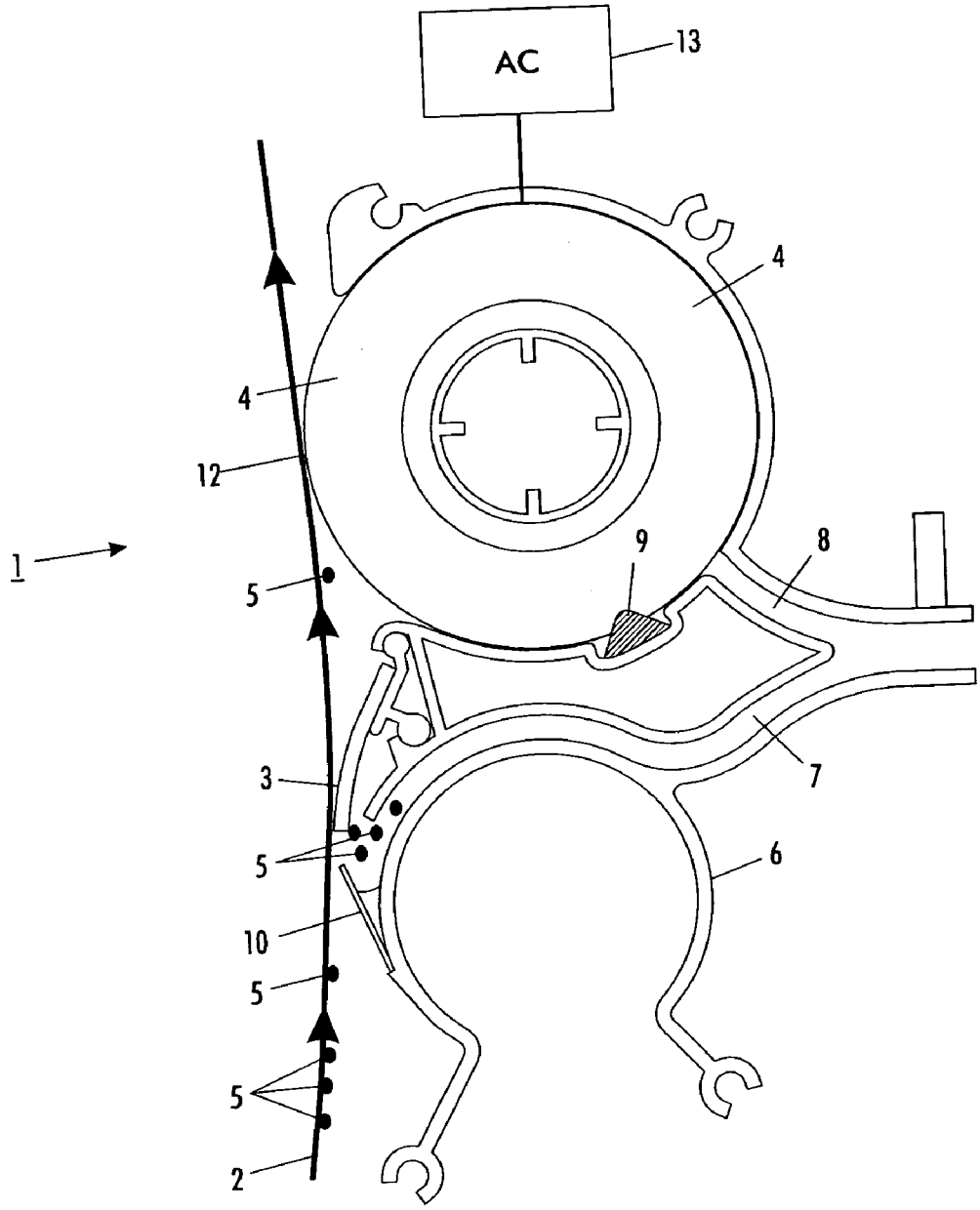
FIG. 1 illustrates an embodiment of the invention using a cleaning subsystem having one cleaning brush.

In FIG. 1, cleaning system 1 of an embodiment, a photoconductive belt 2 is shown as it is adapted to move sequentially first to the cleaning blade 3 and then to an electrostatic brush 4. The elastomeric cleaning blade 3 helps to loosen residual and wrong sign toner from the belt 2. One of the printers for which this is proposed actually uses a cleaning blade at about a 20% duty cycle in the 'doctor mode' after the cleaning brush. The arrows show the direction and path of the PC belt. The blade 3 is therefore upstream from the brush 4 and is the first cleaning component that contacts the belt (see above). In this position, blade 3 gets the proper toner-induced lubrication since toner has not been previously removed by a brush 4 or any other component. The electrostatic brush 4 has an asymmetric AC bias applied to it by AC supply 13 at a frequency sufficiently low so that wrong sign toner will experience a few negative cycles as it passes through the nip 12 and thereby be picked up by the brush 4. This AC bias is applied to the brush 4 by any suitable means such as AC supply 13. The asymmetric AC bias is applied to brush 4 by AC supply 13. The brush 4 is enabled by AC supply 13 to be held at a normal cleaning positive potential but swings negative for a short time during each cycle. Said AC power supply 13 is enabled to provide longer negative swings of wave-form during a system environment of high humidities. This will permit brush 4 to attract the opposite charged or wrong sign toner 5 and remove any residual toner 5 not removed from the PC belt 2 by the cleaning blade 3. As above stated, since the cleaning blade 3 is the first cleaning component contacted by the belt 2, there is sufficient toner 5 on the belt at that point to provide ample lubrication for the blade 3 and minimize abrasion of the belt 2. The electrostatic brush 4 in system 1 follows the blade 3 to remove any residual wrong sign toner 5. In an embodiment, a vacuum unit 6 is positioned between the blade 3 and brush 4 to vacuum off any loosened wrong sign toner removed by either or both blade 3 and brush 4. After the toner is vacuumed out, it can be disposed of by any suitable method. Vacuum air channels 7 and 8 are in air flow contact with the blade 3 and brush 4, respectively. A flicker bar 9 is in operative contact with brush 4 and is adapted to de-tone brush 4 together with vacuum unit 6. As toner 5 is flicked off brush 4 by flicker bar 9, it is picked up by the suction of vacuum channel 8 and transported out of system 1. Flicker bar 9 is positioned such that the asymmetric AC biased fibers in the rotation brush 4 will contact the flicker bar 9 prior to reaching the vacuum channel 8. In FIG. 1, the flicker bar 9 is shown in a position consistent with a counterclockwise brush 4 rotation. Clockwise brush 4 rotation can also be used with the flicker bar 9 in any suitable position. An entry shield 10 is located below the cleaning blade 3 and directs loosened toner into vacuum channel 7 for removal from system 1. Toner 5, therefore, is sequentially removed from photoconductor belt 2, by first contact with blade 3 which scrapes some toner 5 off belt 2 and then by cleaner brush 4 which removes any residual wrong sign toner by brush action.

Figure 2:
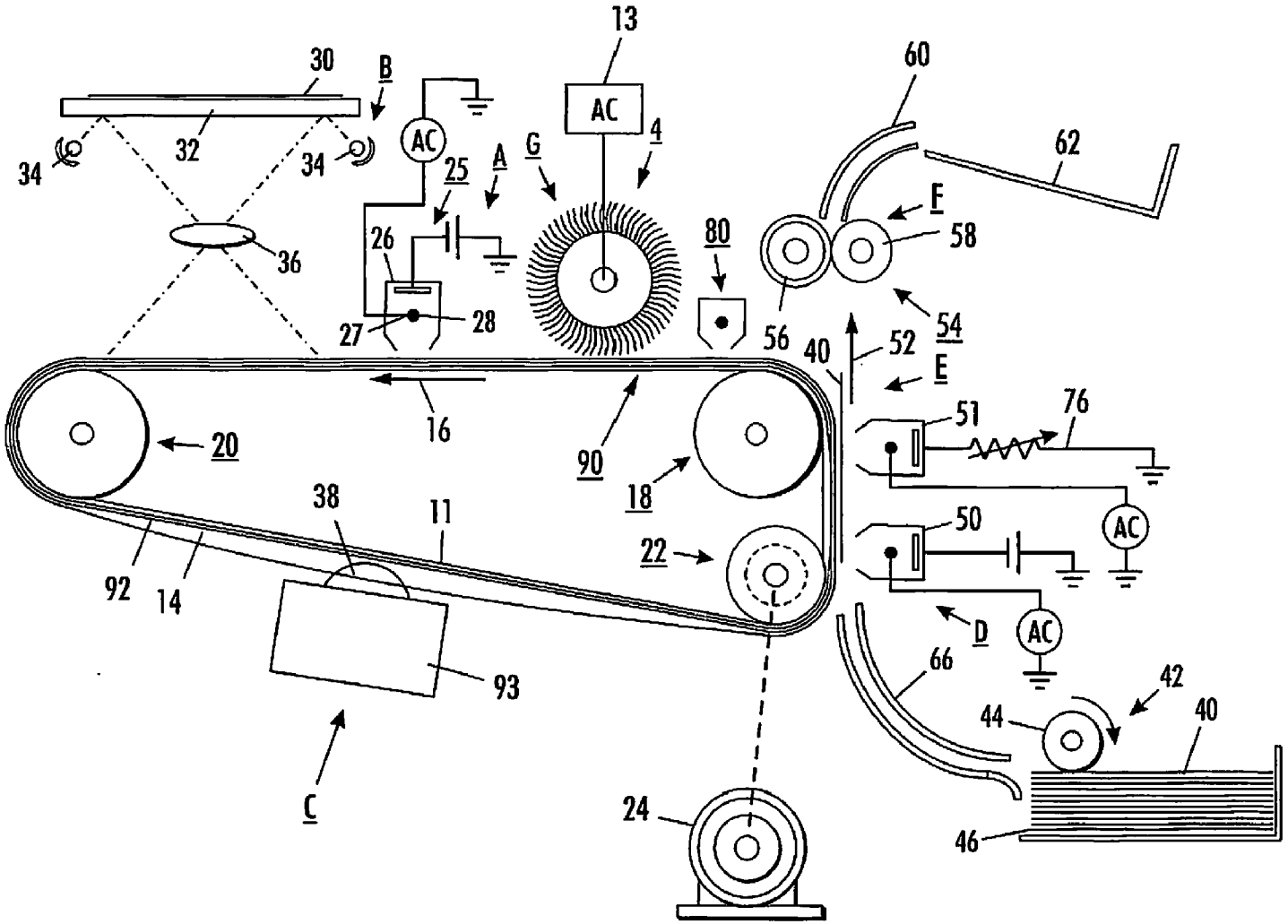
FIG. 2 illustrates an entire electrophotographic marking system using the asymmetric AC biased brush of an embodiment of this invention.

In FIG. 2, the supplier 13 of asymmetric AC bias or charge is shown in electrical contact with cleaning brush 4 as it is used in a substantially complete Xerographic marking system. The components of this Xerographic system are photoconductive belt 90, electrically conductive substrate 11, charge generator layer 92 which generally comprises photoconductive particles dispersed in an electrically insulating organic resin charge transport layer 14, directional arrow 16, stripping roller 18, tension roller 20, drive roller 22, motor 24, corona device 25, conductive shield 26, dicorotron electrode comprised of elongated bare wire 27, electrically insulating layer 28, original document 30, transparent platen 32, lamps 34, lens 36, brush developer roller 38, sheet of support material 40, sheet feeding apparatus 42, feed roll 44, stack 46, chute 66 corona generating device 50, detack corona generating device 51, directional arrow 52, fuser assembly 54 heated fuser roller 56, backup roller 58, fusing sheet 60, catch tray 62, resistor 76, shield circuit of a pre-clean dicorotron 80, conventional cleaning brush 4 and developer sump 93. The following designate the various stations: charging station A, exposure station B, development station C, transfer station D, detack station E, fusing station F and cleaning station G. Developer sump 93 contains both right sign and wrong sign toner and any additives.

A complete description of a typical Xerographic system is given in U.S. Pat. No. 4,564,282 which is incorporated by reference into the present disclosure. A general discussion of Xerography is given above in paragraphs [001]-[004].

In summary, embodiments of the present invention comprise a cleaning subsystem used in an electrophotographic system. This system comprises in an operative arrangement a movable photoconductive surface, a developer sump, an AC power supply and a rotating cleaning brush. The AC power supply 13 or source is in electrical connection to said brush and is enabled to apply an asymmetric AC bias to said brush. This brush is adapted in a cleaning step to contact and clean the photoconductive surface of wrong sign toner. Typical asymmetric AC power sources 13 with variable duty cycles in ranges of 25 to 100% are useful in the present inventions.

Also, in this system, the power supply 13 is enabled to adjustably apply the bias to the brush at a frequency sufficiently low so that wrong sign toner will experience some negative cycles as it passes through a nip and is picked up by the brush. The brush with the bias is enabled to attract and remove both right sign and wrong sign toner from the system. In the cleaning step, the cleaning results in a depletion of wrong sign toners in the sump. The biased brush is enabled to assist wrong sign toner purge from the system and thereby provide improved image development by the use of only right sign toner particles.

As noted, this subsystem is adapted for use in an electrophotographic marking system. This marking system, in general, comprises in an operative arrangement, a charging station, an exposure station, a development station, a transfer station, a cleaning station and a sump or source of toner. The cleaning station is positioned in the marking system after the transfer station but before the charging station. A movable photoconductor used is enabled to pass through each of the stations and is adapted to be cleaned by a cleaning brush located in the cleaning station. This brush is in electrical contact with an adjustable AC power supply 13 wherein the power supply is adapted to apply an asymmetric AC bias to the brush. This biased brush is enabled to remove toner including wrong sign toner particles from the photoconductive surface. The power supply 13 is enabled to apply the bias to the brush at a frequency sufficiently low so that wrong sign toner will experience some negative cycles as it passes through a nip between the brush and the photoconductor surface. The duty cycle of the AC power supply 13 is enabled to be optimized and adjusted according to material charging behavior at variable humidities.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A cleaning subsystem used in an electrophotographic system which comprises in an operative arrangement a movable photoconductive surface, a developer sump, an adjustable AC power supply and a rotating cleaning brush, said power supply in electrical connection to said brush and enabled to apply an asymmetric AC bias to said brush, said brush adapted in a cleaning step to contact and clean said photoconductive surface of both right and wrong sign particles or toner, and wherein said brush is enabled to be held at a normal cleaning positive potential but swings negative for a short time during each cycle.

2. The system of claim 1 wherein said power supply is enabled to apply said bias to said brush at a frequency sufficiently low so that wrong sign toner will experience some negative cycles as it passes through a nip and is picked up by said brush.

3. The system of claim 1 wherein said brush having said bias is enabled to attract and remove wrong sign toner and toner additives from said system.

4. The system of claim 1 wherein said cleaning step results in a depletion of wrong sign toners in said sump.

5. The system of claim 1 wherein a duty cycle of the AC power supply is enabled to be optimized according to material charging behavior at variable humidities.

6. The system of claim 1 wherein said AC power supply is enabled to provide longer negative swings of wave-form during a system environment of high humidities.

7. The system of claim 1 wherein said biased brush is enabled to assist wrong sign toner purge from said system and thereby provide improved image development by said right sign toner particles.

8. A cleaning subsystem useful in an electrophotographic marking system which comprises in an operative arrangement, a movable photoconductive surface, a cleaning brush, a developer sump, an adjustable AC power supply in electrical connection to said brush, and a toner removal component, said power supply enabled to apply an asymmetric AC bias to said cleaning brush, said developer sump adapted to supply toner and toner additives to said photoconductive surface during a development step, said brush adapted in a cleaning step to contact and clean said photoconductive surface of residual particles after said development step, said asymmetric biased cleaning brush enabled to remove both right and wrong sign toner from said photoconductive surface and convey said wrong sign toner outside of said system, and wherein said brush is enabled to be held at a normal cleaning positive potential but swings negative for a short time during each cycle.

9. The system of claim 8 wherein said power supply is enabled to apply said bias to said brush at a frequency sufficiently low so that wrong sign toner will experience some negative cycles as it passes through a nip and is picked up by said brush.

10. The system of claim 8 wherein said brush having said bias is enabled to attract and remove wrong sign toner from said system.

11. The system of claim 8 wherein said cleaning step results in a depletion of wrong sign toners in said sump.

12. The system of claim 8 wherein a duty cycle of the AC power supply is enabled to be optimized and adjusted according to material charging behavior at variable humidities.

13. The system of claim 8 wherein said AC power supply is enabled to provide longer negative swings of wave-form during a system environment of high humidities.

14. An electrophotographic marking system comprising in an operative arrangement, a charging station, an exposure station, a development station, a transfer station, a cleaning station and a sump or source of toner, said cleaning station positioned in said system after said transfer station but before said charging station, a movable photoconductor enabled to pass through each of said stations and adapted to be cleaned by a cleaning brush located in said cleaning station, said brush in electrical contact with an adjustable AC power supply wherein said power supply is adapted to apply an asymmetric AC bias to said brush, said biased brush enabled to remove toner including right and wrong sign toner particles from a photoconductive surface, said power supply enabled to apply said bias to said brush at a frequency sufficiently low so that wrong sign toner will experience some negative cycles at it passes through a nip between said brush and said photoconductor surface, and wherein said brush is enabled to be held at a normal cleaning positive potential but swings negative for a short time during each cycle.

15. The system of claim 14 wherein said cleaning step results in a depletion of wrong sign toners in said sump.

16. The system of claim 14 wherein a duty cycle of the AC power supply is enabled to be optimized according to material charging behavior at variable humidities and other conditions.

17. The system of claim 14 wherein said AC power supply is enabled to provide longer negative swings of wave-form during a system environment of high humidities.

* * * * *